US007557550B2

(12) United States Patent
Mellachurvu et al.

(10) Patent No.: US 7,557,550 B2
(45) Date of Patent: Jul. 7, 2009

(54) SUPPLY REGULATOR USING AN OUTPUT VOLTAGE AND A STORED ENERGY SOURCE TO GENERATE A REFERENCE SIGNAL

(75) Inventors: Murthy R. Mellachurvu, Austin, TX (US); Scott D. Willingham, Austin, TX (US); Peter J. Vancorenland, Austin, TX (US); G. Tyson Tuttle, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 234 days.

(21) Appl. No.: 11/273,695

(22) Filed: Nov. 14, 2005

(65) Prior Publication Data

US 2007/0001657 A1 Jan. 4, 2007

Related U.S. Application Data

(60) Provisional application No. 60/695,780, filed on Jun. 30, 2005.

(51) Int. Cl.
*G05F 1/56* (2006.01)

(52) U.S. Cl. ..... 323/281; 323/901; 363/49

(58) Field of Classification Search ..... 323/281, 323/901, 273, 280, 313; 363/49; 307/45, 307/81, 86

See application file for complete search history.

(56) References Cited

U.S. PATENT DOCUMENTS

| | | | | |
|---|---|---|---|---|
| 5,666,044 | A * | 9/1997 | Tuozzolo | 323/277 |
| 5,889,393 | A * | 3/1999 | Wrathall | 323/282 |
| 6,114,845 | A * | 9/2000 | Capici et al. | 323/313 |
| 6,218,822 | B1 * | 4/2001 | MacQuigg | 323/313 |
| 6,310,467 | B1 * | 10/2001 | Sauer | 323/273 |
| 6,445,167 | B1 * | 9/2002 | Marty | 323/280 |
| 6,844,711 | B1 * | 1/2005 | Sutardja et al. | 323/314 |
| 6,876,180 | B2 * | 4/2005 | Suzuki et al. | 323/270 |
| 7,348,834 | B2 * | 3/2008 | Itoh | 327/539 |
| 2004/0004876 | A1 * | 1/2004 | Choi et al. | 365/202 |
| 2005/0099224 | A1 | 5/2005 | Itoh | |

FOREIGN PATENT DOCUMENTS

| | | |
|---|---|---|
| EP | 1 361 664 | 11/2003 |
| WO | WO 01/23973 | 4/2001 |

* cited by examiner

*Primary Examiner*—Akm E Ullah
*Assistant Examiner*—Harry Behm
(74) *Attorney, Agent, or Firm*—Trop, Pruner & Hu, P.C.

(57) ABSTRACT

A technique includes using a first stored energy source to generate a reference signal to circuitry of a supply regulator in response to the regulator being in a startup state. The technique includes using an output signal that is provided by the regulator to generate the reference signal in response to the regulator not being in the startup state.

6 Claims, 6 Drawing Sheets

SUPPLY REGULATOR USING AN OUTPUT VOLTAGE AND A STORED ENERGY SOURCE TO GENERATE A REFERENCE SIGNAL

This application claims the benefit under 35 U.S.C. § 119 (e) to U.S. Provisional Patent Application Ser. No. 60/695,780, entitled "SUPPLY REGULATOR," filed on Jun. 30, 2005.

BACKGROUND

The invention generally relates to a supply regulator.

A conventional integrated circuit may include at least one supply regulator that furnishes a regulated supply voltage. The supply regulator may use at least one reference current or voltage in its operation. The regulated supply voltage typically is not available for purposes of generating the reference current/voltage during the initial power up, or startup, state of the supply regulator.

SUMMARY

In an embodiment of the invention, a technique includes using a first stored energy source to generate a reference signal in response to a regulator being in a startup state. The technique includes using an output signal that is provided by the regulator to generate the reference signal in response to the regulator not being in the startup state.

In another embodiment of the invention, a circuit includes a regulator, a first reference circuit and a second reference circuit. The regulator regulates a supply signal in response to a reference signal. The first reference circuit supplies the reference signal in response to a battery voltage during a startup state of the regulator; and the second reference circuit supplies the reference signal in response to the supply signal after the startup state.

In yet another embodiment of the invention, a system includes a radio and a supply regulator to generate a regulated voltage that is received by the radio. The supply regulator uses a stored energy source to generate a reference signal during a startup state of the supply regulator and uses the regulated voltage to generate the reference signal after the startup state.

A system includes supply regulators and a radio that includes functional blocks to receive regulated supply voltages from the supply regulators.

Advantages and other features of the invention will become apparent from the following drawing, description and claims.

DETAILED DESCRIPTION

In accordance with some embodiments of the invention, an LDO regulator 10 may be used with a fairly high impedance load that does not draw a significant amount of charge to warrant a large external capacitor. Thus, any requirement of charge may be relatively small and taken care of by internal capacitors of the LDO regulator 10, such as a parasitic gate-to-drain capacitance of a pass transistor 52 of the regulator 10, for example.

Figure 1:
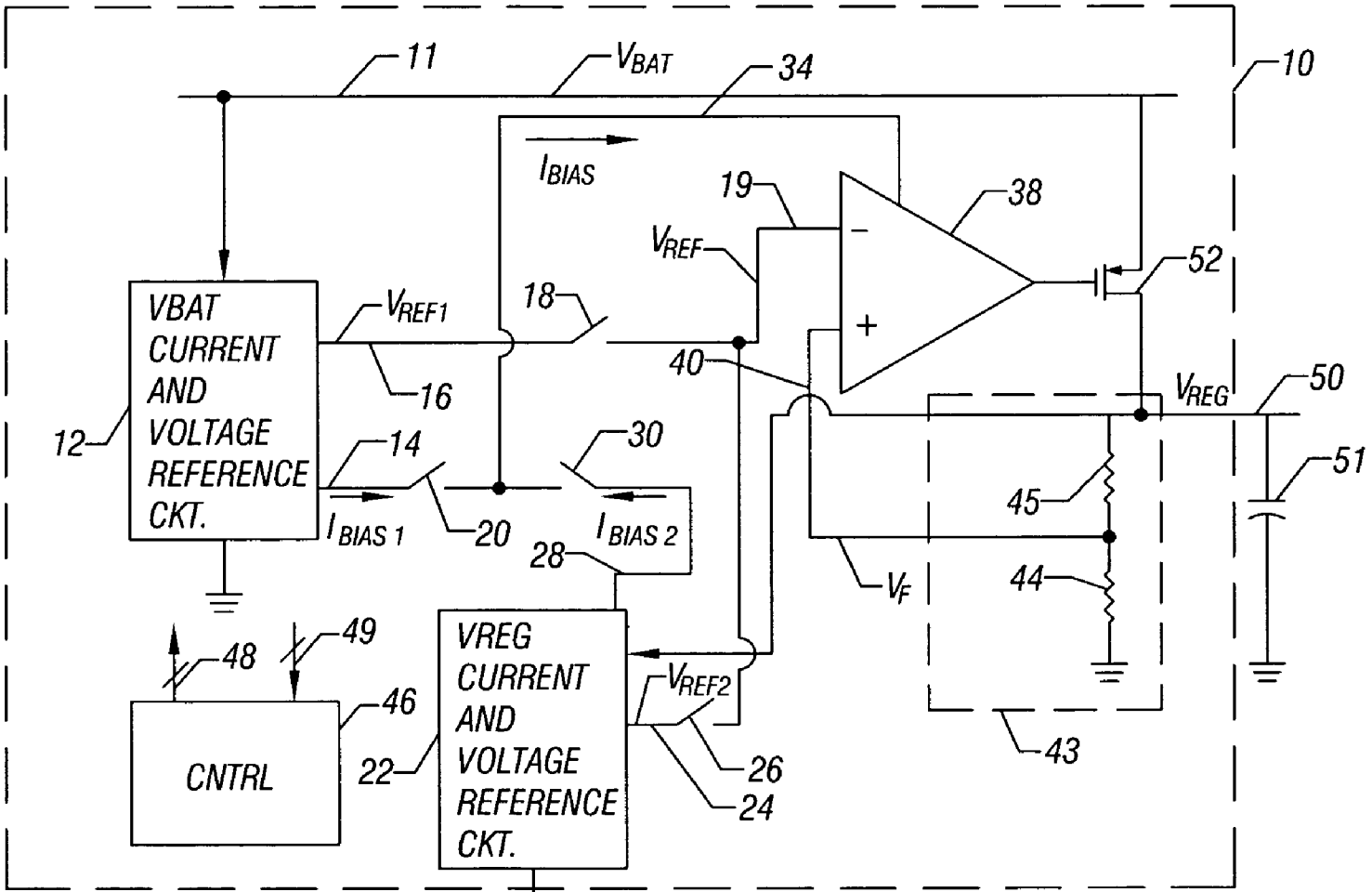
FIG. 1 is a schematic diagram of a low dropout supply regulator according to an embodiment of the invention.

In general, the LDO regulator 10 is a linear regulator that uses the pass transistor 52 for purposes of generating and regulating a supply voltage (called "$V_{REG}$" in FIG. 1) from an input battery voltage (called "$V_{BAT}$" in FIG. 1). More specifically, as depicted in FIG. 1, in accordance with some embodiments of the invention, a conduction path of the transistor 52 may be coupled between the $V_{BAT}$ battery voltage and the $V_{REG}$ supply voltage so that the current through this conduction path may be controlled to regulate the $V_{REG}$ supply voltage at the appropriate level.

As depicted in FIG. 1, in some embodiments of the invention, the transistor 52 may be a p-channel metal-oxide-semiconductor field-effect-transistor (PMOSFET) that has its source terminal coupled to a $V_{BAT}$ battery voltage supply line 11 that is coupled to a stored energy source (such as a battery (not shown) to furnish the $V_{BAT}$ voltage. The drain terminal of the transistor 52 may be coupled to an output terminal 50 (of the LDO regulator 10) that provides the $V_{REG}$ supply voltage. The gate terminal of the transistor 52 may be coupled to the output terminal of an amplifier 38 of the LDO regulator 10. FIG. 1 also depicts a capacitor 51 that is coupled to the regulator's output terminal 50 and represents the capacitance of the load (not shown) that is coupled to the output terminal 50.

The amplifier 38 controls the operation of the pass transistor 52 to regulate the $V_{REG}$ voltage. More specifically, the amplifier 38 receives a signal at its non-inverting input terminal 40, which is indicative of the $V_{REG}$ voltage. In accordance with some embodiments of the invention, the LDO regulator 10 includes a feedback network 43 that is formed from a resistor divider (which includes resistors 44 and 45) that provides a feedback signal (called "$V_F$," in FIG. 1) to the non-inverting input terminal 40, which is proportional to the $V_{REG}$ supply voltage. An inverting input terminal 19 of the amplifier 38 receives a reference signal (called "$V_{REF}$" in FIG. 1); and thus, the amplifier 38 amplifies a difference signal that is indicative of the comparison between the $V_F$ signal and the $V_{REF}$ reference signal.

The amplifier 38 controls the gate terminal voltage of the transistor 52 in response to the differential signal. More specifically, in response to the $V_{REG}$ supply voltage decreasing below the desired regulated level (as indicated by the $V_F$ signal), the amplifier 38 decreases its output signal to cause the transistor 52 to conduct more current to "pull up" on the output terminal 50 to raise the level of the $V_{REG}$ supply voltage. Conversely, in response to the $V_{REG}$ supply voltage increasing above the desired regulated level, the amplifier 38 increases its output signal to cause the transistor 52 to conduct less current to allow a decrease in the $V_{REG}$ supply voltage.

The amplifier 38 may use one or more reference signals in its operation in accordance with embodiments of the invention. For example, as discussed above, the inverting input terminal 19 of the amplifier 38 receives the $V_{REF}$ reference signal. As another example, as depicted in FIG. 1, in accordance with some embodiments of the invention, the amplifier 38 includes an input current bias terminal 34 that receives a bias current (called "$I_{BIAS}$" in FIG. 1) for purposes of biasing certain circuitry of the amplifier 38.

A potential challenge with the use of these reference signals is that the use of the $V_{BAT}$ battery voltage to generate the regulator's reference signals degrades the power supply rejection ratio (PSRR) of the LDO regulator 10. Thus, an alternative may be to generate the reference signals from the $V_{REG}$ supply voltage and not the $V_{BAT}$ battery voltage. However, a challenge with the latter approach is that the $V_{REG}$ supply voltage may not be available during the startup state of the LDO regulator 10. In other words, when the LDO regulator 10 is first turned on, a transient time interval exists in which the regulator 10 is in the startup state in which the regulator 10 brings the $V_{REG}$ supply voltage into regulation. Therefore, when the LDO regulator 10 is in its startup state, the $V_{REG}$ supply voltage is effectively not available to generate reference signals for the LDO regulator 10.

However, in accordance with embodiments of the invention that are described herein, the LDO regulator 10 uses two reference circuits to generate its reference signals to eliminate the above-described shortcomings: a current and voltage reference circuit 12 that generates reference signals from the $V_{BAT}$ battery voltage when the regulator 10 is in its startup state; and a current and voltage reference circuit 22 that generates reference signals for the regulator 10 using the $V_{REG}$ supply voltage after the regulator 10 leaves the startup state and brings the $V_{REG}$ supply voltage within regulation. Due to this arrangement, the PSRR of the LDO regulator 10 is relatively high, and reference signals are available during the initial startup of the regulator 10.

As depicted in FIG. 1, in accordance with some embodiments of the invention, the LDO regulator 10 may include various switches 18, 20, 26 and 30 to control which reference circuit 12, 22 is providing the reference signals for the regulator 10. More specifically, in accordance with some embodiments of the invention, the reference circuit 12 includes an output terminal 16 that provides (via a closed switch 18) a reference voltage (called "$V_{REF1}$" in FIG. 1) to the inverting input terminal 19 of the amplifier 38 when the regulator 10 is in its startup state. The reference circuit 12 also includes an output terminal 14 that provides a bias current (called "$I_{BIAS1}$" in FIG. 1) that is coupled to the input current bias terminal 34 of the amplifier 38 (via the closed switch 20) when the regulator 10 is in its startup state. When, however, the regulator 10 is no longer in its startup state, the regulator 10 opens the switches 18 and 20 to disconnect the reference circuit 12 from providing the $I_{BIAS}$ and $V_{REF}$ reference signals to the amplifier 38.

At this point, the reference circuit 22 provides the reference signals to the amplifier 38. More specifically, in accordance with some embodiments of the invention, the reference circuit 22 includes an output terminal 24 that provides a reference voltage (called "$V_{REF2}$" in FIG. 1) and includes an output terminal 28 that provides a reference current signal (called "$I_{BIAS2}$" in FIG. 1). The output terminals 24 and 28 are coupled to the terminals 19 and 34, respectively, of the amplifier 38 by switches 26 and 30, respectively, after the regulator 10 brings the $V_{REG}$ supply voltage under regulation. Although, the switches 26 and 30 are initially open at power up of the LDO regulator 10, the regulator 10 closes the switches 26 and 30 after the LDO regulator leaves its startup state so that the reference circuit 22 provides the $V_{REF2}$ and $I_{BIAS2}$ reference signals to the amplifier 38.

As depicted in FIG. 1, in accordance with some embodiments of the invention, the regulator 10 may include a control circuit 46 that provides output signals (at its output terminals 48) to control the various above-described switches to regulate which reference circuit 12, 22 provides the reference signals. The control circuit 46 may, for example, receive various status signals (via input terminals 49) to determine the appropriate timing. For example, in accordance with some embodiments of the invention, the control circuit 46 at power up may initially close the switches 18 and 20 and open the switches 26 and 30; thereafter, the control circuit 46 may monitor the $V_{REG}$ supply voltage to determine when the $V_{REG}$ supply voltage has reached its regulated level; and in response to the $V_{REG}$ supply voltage reaching its regulated level, the control circuit 46 may open the switches 18 and 20 and close the switches 26 and 30.

It is noted that the architecture that is depicted in FIG. 1 is an example of many different possible architectures for the LDO regulator 10 in accordance with the many possible embodiments of the invention. For example, as further described below, in accordance with some embodiments of the invention, the regulator 10 may not include explicit switches, such as one or more of the switches 16, 18, 20, 26 and 30. Instead, the regulator 10 may control when the reference circuits 12 and 22 are enabled and disabled so that, in general, the output terminals of the reference circuits 12 and 22 are coupled together; the reference circuit 12 is enabled (and the reference circuit 22 is disabled) to provide the $V_{REF}$ and $I_{BIAS}$ reference signals during the startup of the regulator 10; and the reference circuit 22 is enabled (and the reference circuit 12 is disabled) to provide the $V_{REF}$ and $I_{BIAS}$ reference signals after the startup of the regulator 10.

Figure 2:
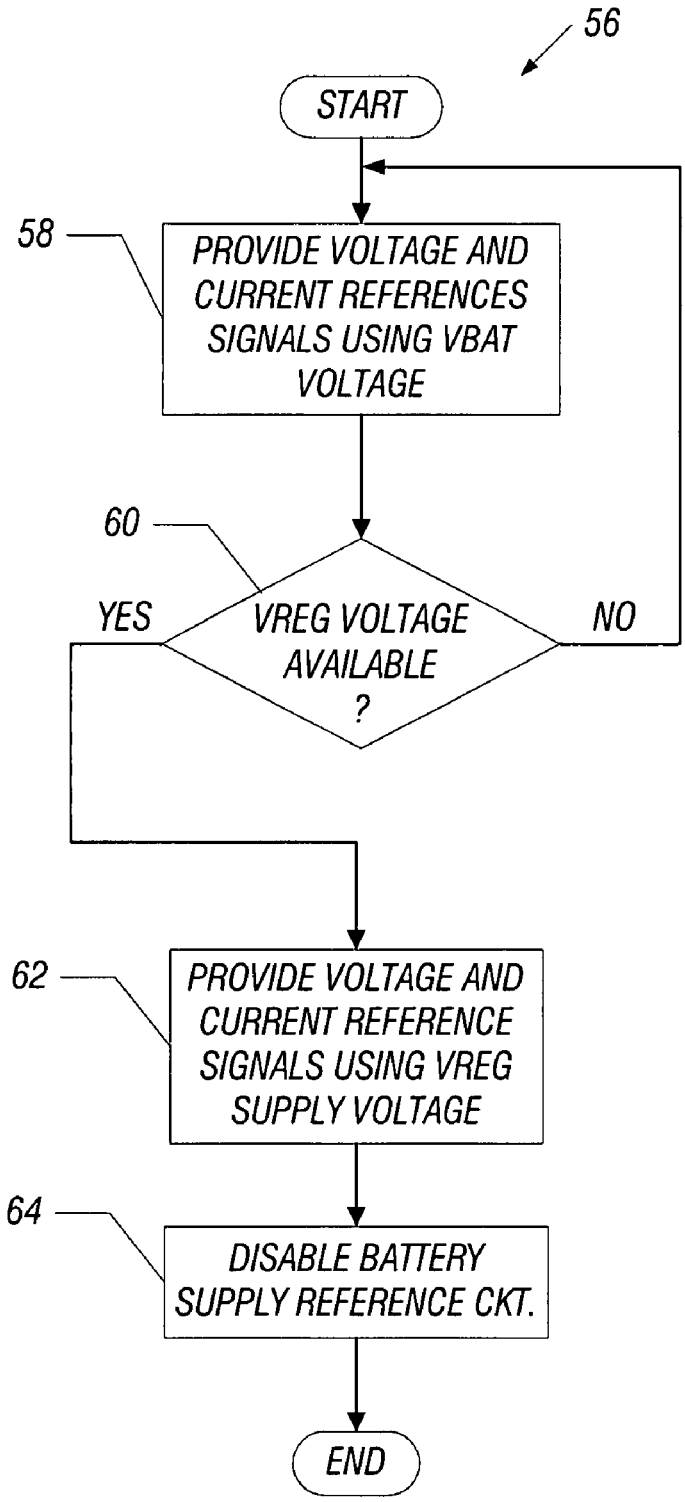
FIG. 2 is a flow diagram depicting a technique used by the supply regulator according to an embodiment of the invention.

Referring to FIG. 2 in conjunction with FIG. 1, in accordance with some embodiments of the invention, the LDO regulator 10 generally performs a technique 56. Pursuant to the technique 56, the regulator 10 provides (block 58) voltage and current reference signals using the $V_{BAT}$ battery supply voltage and concurrently determines whether the $V_{REG}$ supply voltage is available (diamond 60). If the $V_{REG}$ supply voltage is unavailable, then the regulator 10 continues to provide (block 58) the voltage and current reference signals using the $V_{BAT}$ battery supply voltage. However, after the $V_{REG}$ supply voltage becomes available, the regulator 10 provides (block 62) the voltage and current reference signals using the $V_{REG}$ supply voltage, as depicted in block 62. Subsequently or concurrently therewith, the regulator 10 disables (block 64) the reference circuit 12.

Figure 3:
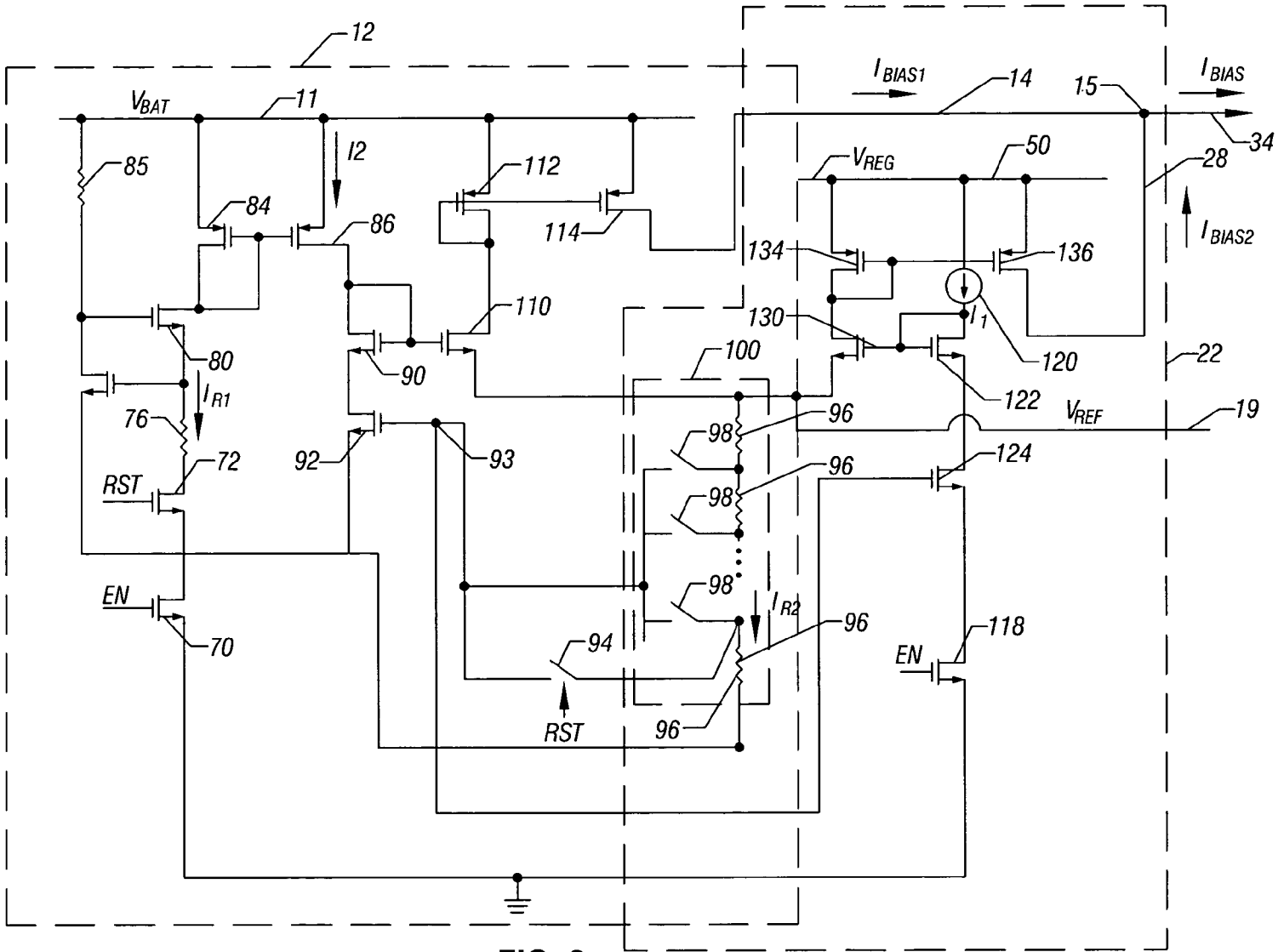
FIG. 3 is a more detailed schematic diagram illustrating the current and voltage reference circuits of the supply regulator according to an embodiment of the invention.

FIG. 3 depicts a schematic diagram illustrating, for purposes of example, a more specific architecture for the reference circuits 12 and 14, in accordance with some embodiments of the invention. It is assumed for purposes of the discussion below that a signal (called "RST," in FIG. 3) is asserted (driven high, for example) at power up of the LDO regulator 10; and the RST signal is deasserted in response to the LDO resistor 10 bringing the $V_{REG}$ supply voltage under regulation to keep the reference circuit 12 disabled (as further described below). It is also assumed for purposes of the discussion that a regulator enable signal (called "EN," in FIG. 3) is also asserted and remains asserted for purposes of enabling the general operation of the regulator 10. Due to the assertion of the RST signal, an n-channel metal-oxide-semiconductor field-effect-transistor (NMOSFET) 72 of the LDO regulator 10 is activated and a switch 94 of the regulator 10 is closed. Therefore, it will be assumed for the discussion herein that the drain-to-source path of the NMOSFET 72 and the switch path of the switch 94 may be represented by no-loss conduction paths. Similarly, it is assumed herein that when the EN signal is asserted, the drain-to-source paths of NMOSFETs 70 and 118 may be represented likewise by no loss conduction paths.

In accordance with some embodiments of the invention, the reference circuit 12 includes a $V_{T/R}$ current reference source that provides a bias current that is independent of the $V_{BAT}$ battery voltage. More specifically, the reference circuit 12 includes an NMOSFET 78 that has its source terminal coupled to ground and its gate terminal coupled to a terminal of a resistor 76. The other terminal of the resistor 76 is coupled to ground. As depicted in FIG. 3, another resistor 85 may be coupled between the drain terminal of the NMOSFET 78 and the $V_{BAT}$ battery voltage supply line 11. Due to this arrangement, the resistance of the resistor 76 and the $V_T$ threshold voltage of the NMOSFET 78 may be chosen to establish a reference bias current (called "$I_{R1}$" in FIG. 3) through the resistor 76, which is independent of the $V_{BAT}$ battery voltage. The $I_{R1}$ reference bias current flows through the drain-to-source path of an NMOSFET 80. As depicted in FIG. 3, the gate terminal of the NMOSFET 80 may be coupled to the drain terminal of the NMOSFET 78, and the drain terminal of the NMOSFET 80 may be coupled to the drain terminal of a p-channel metal-oxide-semiconductor field-effect-transistor (PMOSFET) 84.

The PMOSFET 84 and a PMOSFET 86 form a current mirror of the reference circuit 12. More specifically, the gate terminals of the PMOSFETs 84 and 86 are coupled together, and the source terminals of both PMOSFETs 84 and 86 are coupled to the $V_{BAT}$ battery voltage supply line 11. Additionally, the gate terminal of the PMOSFET 84 is coupled to its drain terminal. Because the source-to-gate voltages of the PMOSFETs 84 and 86 are the same, the current (called "$I_2$" in FIG. 3) through the source-to-drain path of the PMOSFET 86 is a scaled version (depending on the relative aspect ratios of the PMOSFET2 84 and 86) of the $I_{R1}$ reference bias current.

The $I_2$ current flows through the drain-to-source path of an NMOSFET 90. More specifically, the drain terminal of the NMOSFET 90 is coupled to the drain terminal of the NMOSFET 86 and to the gate terminal of the NMOSFET 90. The source terminal of the NMOSFET 90 is coupled to the drain terminal of another NMOSFET 92, and the source terminal of the NMOSFET 92 is coupled to ground. Thus, the $I_2$ bias current also flows through the drain-to-source path of the NMOSFET 92.

The gate terminal of the NMOSFET 92 is coupled to a node 93, and during the startup of the regulator 10, the node 93 has a voltage equal to the gate-to-source voltage of the NMOSFET 92. Furthermore, during the startup of the regulator 10, a resistor 96 is coupled between the node 93 and ground. Therefore, the resistance of the resistor 96 is selected to produce a current (called "$I_{R2}$" in FIG. 3) through the resistor 96 that is proportional to the gate-to-source voltage of the NMOSFET 92, a voltage that is a function of the $I_2$ bias current.

The resistor 96 is the lowest (relative to ground) of a series of resistors 96 that are coupled between ground and the source of an NMOSFET 110 and ground. Thus, the $I_{R2}$ current flows through the drain-to-source path of the NMOSFET 110. As depicted in FIG. 3, the gate terminal of the NMOSFET 110 may be coupled to the gate terminal of the NMOSFET 90.

The drain terminal of the NMOSFET 110 is coupled to another current mirror that is formed from PMOSFETs 112 and 114. More specifically, the drain terminal of the PMOSFET 112 is coupled to the drain terminal of the NMOSFET 110, and the gate terminals of the PMOSFETs 112 and 114 are coupled together. The gate and drain terminals of the PMOSFET 112 are coupled together; and the source terminals of the PMOSFETs 112 and 114 are coupled to the $V_{BAT}$ battery voltage supply terminal 11. The drain terminal of the PMOSFET 114 forms the output terminal 14 of the reference circuit 12. When the reference circuit 12 is enabled, the $I_{BIAS1}$ current flows through the source-to-drain path of the PMOSFET 114, and the $I_{BIAS1}$ current is a scaled version (depending on the relative aspect ratios of the PMOSFETs 112 and 114) of the $I_{R2}$ current.

As depicted in FIG. 3, in accordance with some embodiments of the invention, a switch is not explicitly coupled between the output terminal 14 of the reference circuit 12 and the input bias terminal 34 of the amplifier 38 (see FIG. 1). Instead, the reference current output terminals 14 (of the reference circuit 12) and 28 (of the reference circuit 22) are coupled together at a current summing node 15. As further described below, during the startup of the LDO regulator 10, the reference circuit 22 is disabled and the reference circuit 12 is enabled; and as a result, the $I_{BIAS1}$ current (being the only current provided to the current summing node 15) is the $I_{BIAS}$ current. After startup, the reference circuit 12 is disabled and the reference circuit 22 is enabled; and as a result, the $I_{BIAS2}$ current appears as the $I_{BIAS}$ current at the input bias terminal 34, as the $I_{BIAS2}$ current is the only current that is provided to the current summing node 15.

As depicted in FIG. 3, in accordance with some embodiments of the invention, the source terminal of the NMOSFET 110 is coupled to the inverting input terminal 19 of the amplifier 38. Thus, during the startup of the LDO regulator 10, the source terminal of the NMOSFET 110 provides the $V_{REF}$ voltage. As further described below, after the LDO regulator 10 leaves its startup state, the NMOSFET 110 is turned off, and the reference circuit 22 (also coupled to the inverting input terminal 19) provides the $V_{REF}$ reference voltage.

When the reference circuit 12 is enabled, the $V_{REF}$ reference voltage is formed from the product of the $I_{R2}$ current and the resistances of the resistors 96. The resistors 96 are part of a calibration circuit 100 that is enabled with the reference circuit 22 to trim the $V_{REF}$ reference voltage to account for process variations, as one of a set of switches 98 is selectively closed for purposes of trimming, or adjusting, the $V_{REF}$ reference voltage. However, this calibration feature is not used when the reference circuit 12 is enabled, in accordance with some embodiments of the invention.

Regarding the specific structure of the reference circuit 22 depicted in FIG. 3, in accordance with some embodiments of the invention, the reference circuit 22 includes a current source 120 that furnishes a bias reference current (called "$I_1$" in FIG. 3). The current source 120 may be a $V_{T/R}$ current source, in some embodiments of the invention. As shown in FIG. 3, the current source 120 may be coupled between the output terminal 50 of the amplifier 38 (see FIG. 1) and a drain terminal of an NMOSFET 122. The gate terminal of the NMOSFET 122 is coupled to its drain terminal, and the gate terminal of the NMOSFET 122 is coupled to the drain terminal of another NMOSFET 124. The source terminal of the NMOSFET 124 is coupled to ground, and the gate terminal of the NMOSFET 124 is coupled to the node 93.

Due to the above-described arrangement, the $I_1$ current flows through the drain-to-source path of the NMOSFET 124. Thus, the gate-to-source voltage of the NMOSFET 124 is a function of the $I_1$ current.

The gate-to-source voltage of the NMOSFET 124 is connected in parallel to the gate-to-source voltage of the NMOSFET 92. In accordance with some embodiments of the invention, the NMOSFET 92 is significantly stronger than the NMOSFET 124. In other words, the aspect ratio (i.e., the channel width-to-length ratio) of the NMOSFET 92 is significantly larger than the aspect ratio of the NMOSFET 124. The current flowing through the drain-to-source path of the NMOSFET 124 may be generally the same as the current flowing through the drain-to-source path of the NMOSFET 92. However, because of the relative aspect ratio differences, when the NMOSFET 124 turns on (i.e., when the $V_{REG}$ supply voltage rises to its regulation level), the gate-to-source voltage of the NMOSFET 124 controls, thereby lowering the voltage of the gate of the NMOSFET 110 to turn off the NMOSFET 110 and thus, disable the reference circuit 12.

The gate-to-source voltage of the NMOSFET 124 establishes the $I_{R2}$ current through the calibration circuit 100 and as a result, establishes the $V_{REF}$ reference voltage and the $I_{BIAS2}$ current. More specifically, in accordance with some embodiments of the invention, the node 93 is connected to a particular point of the serial chain of resistors 96 by one of the switches 98. Therefore, by selecting the particular connection point of the node 93 to the chain of resistors 96, the $V_{REF}$ reference voltage may be trimmed.

The resistance between the input terminal 19 and ground is the same regardless of the connection of the switches 98. Therefore, when the $V_{REF}$ reference voltage is set to the appropriate level, the $I_2$ current is also at the appropriate level.

The $I_{R2}$ current flows through the drain-to-source path of the NMOSFET 130. The source terminal of the NMOSFET 130 is connected to the terminal 19, the gate terminal of the NMOSFET 130 is coupled to the gate terminal of the NMOSFET 122, and the drain terminal of the NMOSFET 130 is coupled to the drain terminal of a PMOSFET 134.

The gate terminal of the PMOSFET 134 is coupled to its drain terminal, as the source terminal of the PMOSFET 134 is coupled to the $V_{REG}$ supply line 50. Thus, the $I_{R2}$ bias reference circuit flows through the source-to-drain path of the PMOSFET 134.

The PMOSFET 134 forms one half of a current mirror. More specifically, in accordance with some embodiments of the invention, the other half of the current mirror is formed by a PMOSFET 136 that has its source terminal coupled to the $V_{REG}$ supply voltage line 50. The gate terminal of the PMOSFET 136 is coupled to the gate terminal of the PMOSFET 134, and the drain terminal of the PMOSFET 136 forms the output terminal 28 of the reference circuit 22. Therefore, depending on the particular embodiment of the invention, the $I_{BIAS2}$ current may be the same or a scaled version of the current that flows through the source-to-drain path of the PMOSFET 134, depending on the relative aspect ratios of the PMOSFETs 134 and 136.

It is noted that although the reference circuit 12 is disabled upon the powering up of the reference circuit 22, in accordance with some embodiments of the invention, the RST signal is de-asserted (driven low, for example) after this event for purposes of ensuring that the reference circuit 12 does not subsequently become re-enabled. Thus, the de-assertion of the RST signal removes the ground connection for the $V_{T/R}$ current reference of the reference circuit 12.

Figure 4:
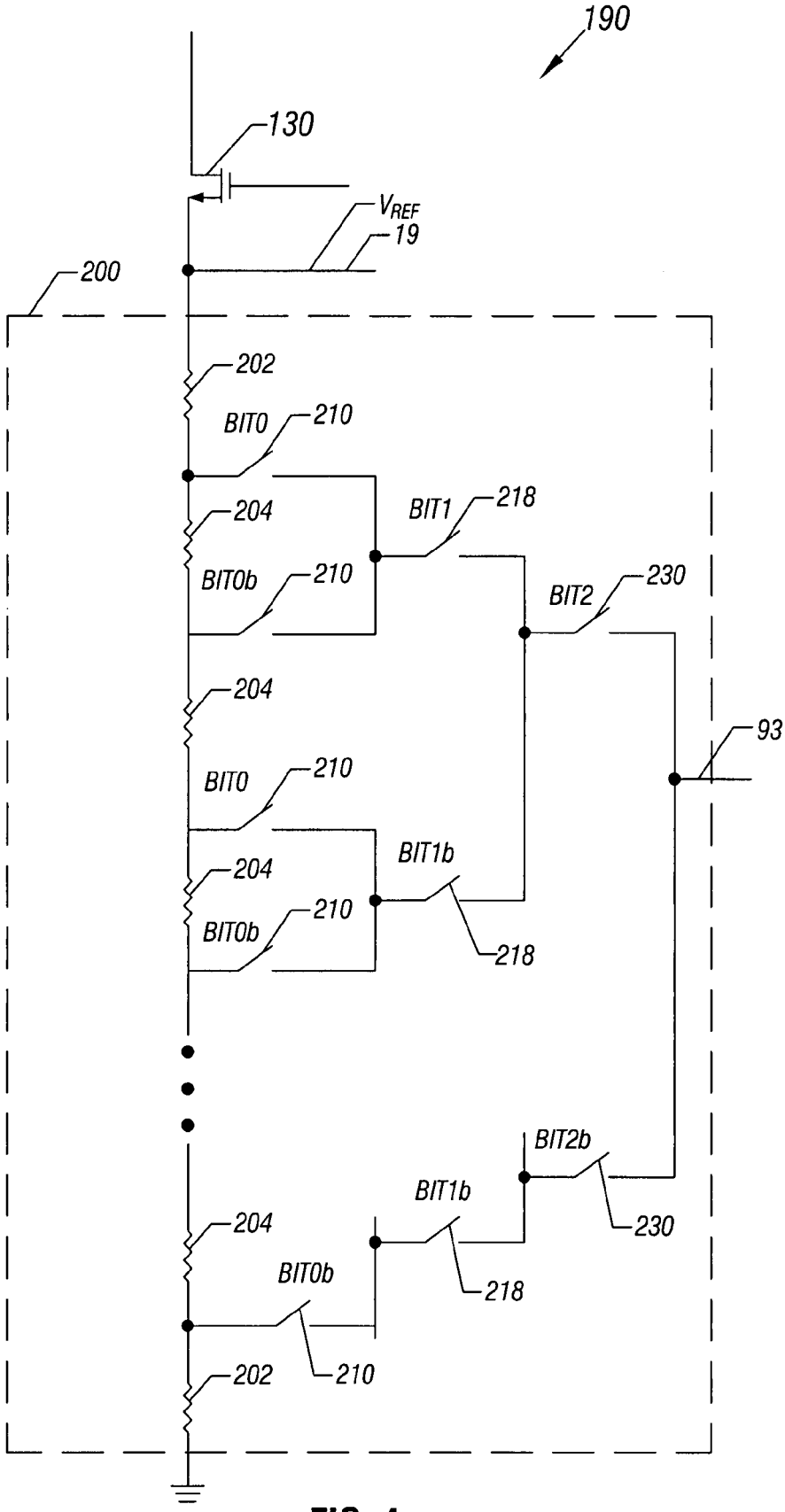
FIGS. 4 and 5 depict alternative calibration circuits according to other embodiments of the invention.

The calibration circuit 100 of FIG. 3 is depicted and described herein to illustrate one out of many possible calibration circuits for use by the reference circuit 22. It is noted, however, that other calibration circuits may be used in other embodiments of the invention. For example, FIG. 4 depicts a calibration circuit 190 that may be used in place of the calibration circuit 100 in accordance with some embodiments of the invention. Referring to FIG. 4 in conjunction with FIG. 3, in accordance with some embodiments of the invention, the calibration circuit 190 may include a string of serially-coupled resistors 204 that are located between the source terminal of the NMOSFET 130 and ground. Furthermore, larger resistors 202 may be coupled between one end of the string of resistors 204 and the source terminal of the NMOSFET 130; and between the lower end of the string of resistors 204 and ground. Switches are activated by bits in response to a digital calibration value for purposes of coupling the node 93 to a particular point of the string of resistors 204. As depicted in FIG. 4, the nodes of the string of resistors 204 may be coupled to switches 210 that are selectively activated based on the logical state of bit position zero of the digital calibration value. As shown, one half of the switches 210 may be activated in response to a logical one state for bit position zero, and the other half of the switches 210 may be activated by a logical zero state for bit position zero. Similarly, the calibration circuit 190 includes switches 218 that are opened and closed depending on the particular state of bit position one; and the calibration circuit 190 includes switches 230 that are opened and closed based on the logical states of bit position two. The net result of the switches 210, 218 and 230 is a decision tree that couples a node of the string of resistors 204 to the node 93.

Calibration circuits 190 and 100 are similar in design. Both circuits 100 and 190 are different from a calibration circuit 250 (FIG. 5), which is described below.

Figure 5:
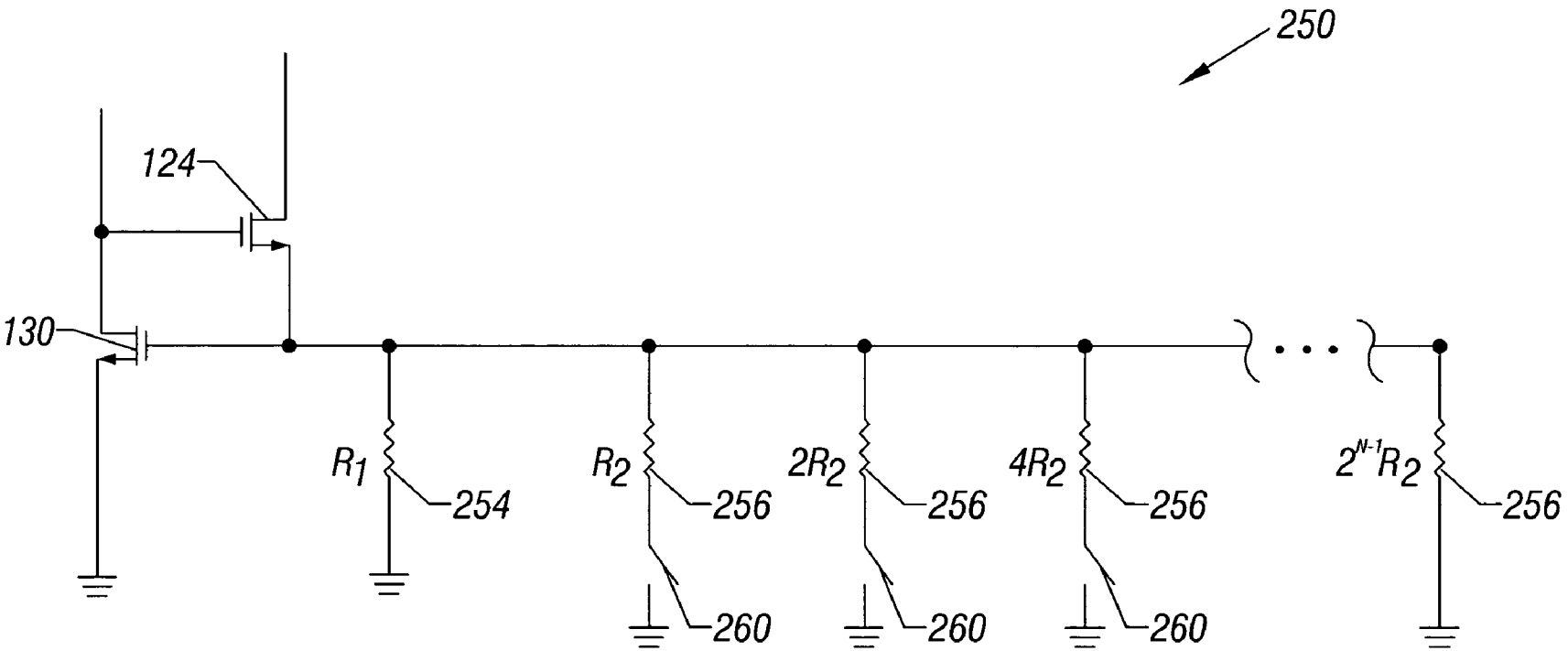

As an example of yet another possible embodiment for the calibration circuit, FIG. 5 depicts a calibration circuit 250 in accordance with some embodiments of the invention. Referring to FIG. 5, for the calibration circuit 250, the source terminal of the NMOSFET 130 is coupled to ground, and the drain terminal of the NMOSFET 130 is coupled to the gate terminal of the NMOSFET 124. Furthermore, the source terminal of the NMOSFET 124 is coupled to the gate terminal of the NMOSFET 130. Binarily-weighted resistors 256 are selectively coupled between the source terminal of the NMOSFET 124 and ground. More specifically, each of the binarily-weighted resistors 256 may be coupled to ground by an associated switch 260 that is located between one terminal of the resistor 256 and ground. Therefore, by selecting the appropriate switch 260, the resistance seen at the source terminal of the NMOSFET 124 may be selected. As also depicted in FIG. 5, the calibration circuit 250 may also include a resistor 254 that is permanently coupled between the source terminal of the NMOSFET 124 and ground.

In accordance with some embodiments of the invention, the above-described regulator 10 may be incorporated into a system, such as a frequency modulation (FM) receiver 300. The FM receiver 300 may be formed on a semiconductor die of a semiconductor package in accordance with some embodiments of the invention. However, other embodiments of the invention are possible, such as embodiments in which the FM receiver is formed on multiple dies and/or multiple semiconductor packages.

In accordance with some embodiments of the invention, the FM receiver 300 includes LDO supply regulators 350, 352, 354 and 356, which each have a design similar to the regulator 10 and operates independently from the other regulators. Thus, each of the regulators 350, 352, 354 and 356 may, in accordance with some embodiments of the invention, use a battery voltage to supply reference signals for the regulator during a startup phase of the regulator and thereafter use a regulated voltage to furnish the reference signals.

Figure 6:
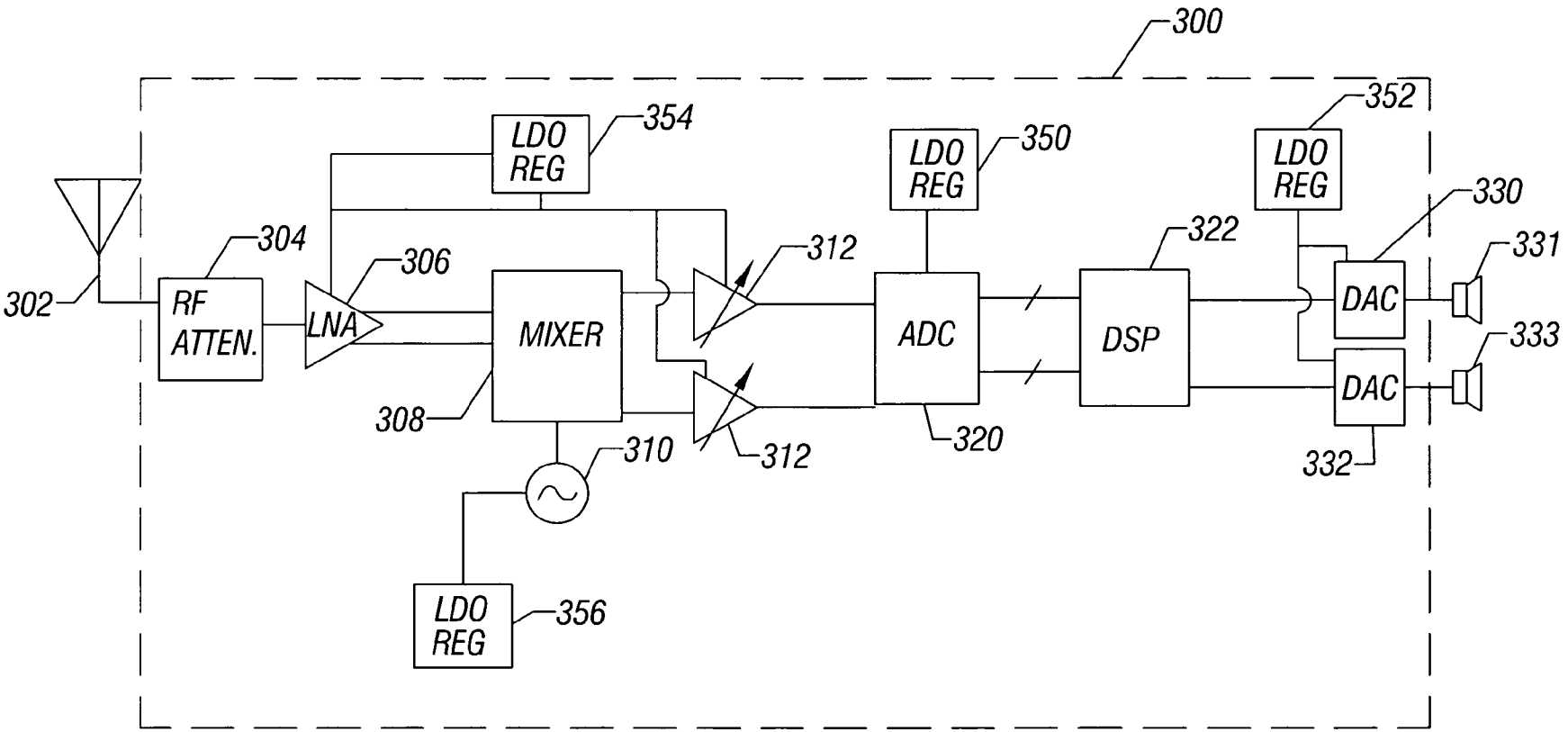
FIG. 6 is a block diagram of a radio receiver according to an embodiment of the invention.

Among the other features of the FM receiver 300, in accordance with some embodiments of the invention, the FM receiver 300 includes an antenna 302 that furnishes an RF signal that is attenuated by an RF attenuator 304. The output terminal of the RF attenuator 304, in turn, may be coupled to the input terminal of a low noise amplifier (LNA) 306. In accordance with some embodiments of the invention, the LNA 306 has output terminals that provide a differential output signal to a mixer 308. As an example, the mixer 308 may translate the frequency of the differential signal that is provided by LNA 306 to an intermediate frequency (IF). The mixer 308 may be coupled to a voltage controlled oscillator (VCO) 310 to receive one or more signals used in the frequency translation. Additionally, as depicted in FIG. 6, the mixer 308 may have output terminals that supply I and Q IF signals to programmable gain amplifiers (PGAs) 312. As depicted in FIG. 6, in accordance with some embodiments of the invention, the LNA 306, mixer 308 and the PGAs 312 may all receive a regulated supply voltage from the LDO supply voltage regulator 354. Furthermore, as depicted in FIG. 6, the VCO 310 may receive a regulated supply voltage from the LDO regulator 356.

In accordance with some embodiments of the invention, the output signals (providing amplified I and Q signals) of the PGAs 312 are received by an analog-to-digital converter (ADC) 320 of the receiver 300. The ADC 320 may have dual channels for purposes of digitizing the I and Q signals. As depicted in FIG. 6, in accordance with some embodiments of the invention, the ADC 320 may receive its regulated supply voltage from the LDO supply voltage regulator 320.

In accordance with some embodiments of the invention, the output terminals of the ADC 320 provide digitized I and Q signals to a digital signal processor (DSP) 322. Among its various functions, the DSP 322 may perform translation of the IF frequency to a baseband frequency and demodulation of the baseband signal to produce left and right channel digital audio signals that are provided to a left channel digital-to-analog converter (DAC) 330 and a right channel DAC 332. The output terminals of the DACs 330 and 332 may, for example, provide audio output signals to speakers 331 and 333, respectively. As depicted in FIG. 6, in accordance with some embodiments of the invention, the DACs 330 and 332 may receive a supply voltage from the LDO regulator 352.

Because the LDO supply regulators 350, 352, 354 and 356 may be used with high impedance loads, the regulators 350, 352 and 354 help in isolating the functional blocks (such as the RF and ADC blocks, as an example) of the FM receiver 300 from each other.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

using a stored energy source to generate a reference signal in response to a supply regulator being in a startup state, comprising enabling a first reference circuit in response to the regulator being in the startup state and calibrating a subcircuit of the first reference circuit in response to the regulator being in the startup state;

using an output signal provided by the regulator to generate the reference signal in response to the regulator not being in the startup state, comprising enabling a second reference circuit other than the first reference circuit in response to the regulator not being in the startup state and causing the second reference circuit to use the calibrated subcircuit to generate the reference voltage;

amplifying a signal indicative of a difference between the output signal and the reference signal to generate a control signal; and controlling an output stage of the regulator in response to the control signal.

2. The method of claim 1, wherein the act of using the stored energy source comprises coupling the a first reference circuit to a battery to provide the reference signal in response to the startup state of the regulator.

3. The method of claim 2, further comprising:

disabling the first reference circuit in response to the regulator not being in the startup state.

4. The method of claim 1, wherein the reference signal comprises one of a reference voltage and a reference current.

5. The method of claim 1, further comprising:

disabling the first reference circuit in response to the operation of the second reference circuit.

6. The method of claim 1, further comprising:

in response to the regulator transitioning out of the startup state, asserting a signal to prevent the first reference circuit from being re-enabled the startup state.

* * * * *

UNITED STATES PATENT AND TRADEMARK OFFICE

CERTIFICATE OF CORRECTION

PATENT NO. : 7,557,550 B2
APPLICATION NO. : 11/273695
DATED : July 7, 2009
INVENTOR(S) : Murthy R. Mellachurvu et al.

It is certified that error appears in the above-identified patent and that said Letters Patent is hereby corrected as shown below:

Column 10, line 22:
"the a first" should be --the first--.

Signed and Sealed this

Fifteenth Day of September, 2009

David J. Kappos

David J. Kappos
*Director of the United States Patent and Trademark Office*